United States Patent [19]

Hull

[11] Patent Number: 4,679,791

[45] Date of Patent: Jul. 14, 1987

[54] SET OF GOLF CLUBS

[76] Inventor: Donald R. Hull, 501½ Hickory St., Perrysburg, Ohio 43551

[21] Appl. No.: 676,517

[22] Filed: Nov. 29, 1984

[51] Int. Cl.[4] ..... A63B 53/00

[52] U.S. Cl. ..... 273/77 A; 273/81 B; 273/169

[58] Field of Search ..... 273/77 A, 81.4, 80 A, 273/81 B, 169, 170, 171, 172, 173, 174, 175

[56] References Cited

U.S. PATENT DOCUMENTS

| | | | |
|---|---|---|---|
| 2,231,847 | 2/1941 | Dickson et al. | 273/80 A |
| 2,960,338 | 11/1960 | Havey et al. | 273/80 A |
| 3,984,103 | 10/1976 | Nix | 273/77 A |

FOREIGN PATENT DOCUMENTS

| | | | |
|---|---|---|---|
| 499895 | 1/1939 | United Kingdom | 273/81.4 |

*Primary Examiner*—George J. Marlo
*Attorney, Agent, or Firm*—Emch, Schaffer, Schaub & Porcello Co.

[57] ABSTRACT

The invention is directed to a set of golf clubs having a plurality of iron type clubs and a plurality of wood type clubs. A first shaft is provided for the iron type clubs and a second shaft is provided for the wood type clubs. The first and second shafts have a first end and a second end. The first shaft has a common length and weight for each of the iron type clubs and the second shaft has a common length and weight for each of the wood type clubs. A grip is positioned on the first end of the first and second shafts. A hosel is positioned on the second end of the first and second shafts. An iron type club head is connected to the hosel positioned on the second end of the first shaft. The iron type club head has a common weight and lie and the iron type club head has a striking face. A wood type club head is connected to the hosel positioned on the second end of the second shaft. The wood type club head has a common weight and lie and the wood type club head has a heel connected to the hosel, a toe spaced apart from the hosel and a striking face. The weight for the entire iron type and wood type clubs is distributed so that one-half of the weight lies in the toe of the club heads and the remaining one-half of the club weight lies in the grip, shaft, hosel and heel of the clubs and the center of gravity of the iron type and wood type clubs is positioned in substantially the center of the iron type and wood type club head. The center of gravity is located by suspending the club from the top centerpoint of the grip. A plumb line that extends through the suspension point for the club is then used to locate the line of percussion or center of gravity for the club. The club also has a grip with substantially flat and parallel sides. The flat sides of the grip are disposed sustantially parallel to the score lines on the striking face of the club head.

10 Claims, 13 Drawing Figures

SET OF GOLF CLUBS

BACKGROUND OF THE INVENTION

The present invention relates to an improved set of golf clubs wherein the irons have a common club weight, length and lie. The woods also have a common club weight, length and lie. In addition, both the irons and the woods have an improved location for the center of gravity for the clubs based on the distribution of the total club weight distribution. Thus, the only real variant in both the irons and the woods is the club face loft. As a result, a golfer using the Applicant's set of golf clubs only has to learn one swing for all the irons and one swing for all the woods as opposed to a different swing for each individual club with present golf club sets.

Under current USGA rules, a golfer is permitted to carry 14 clubs during a round of golf. A typical set of golf clubs will include a putter, 4 woods and 9 irons. The length, lie and club weight of each of the golf clubs is different for each numbered club. Most manufacturers vary the individual club lengths by ½ inch with the lowest numbered club having the longest length. Thus, if the number nine iron is 35½ inches long, the eight iron would be 36 inches, the seven iron 36½ inches, etc., all the way to the number one iron which would be 39½ inches long or 4 inches longer that the number nine iron. With the woods, the club lengths are also varied with the driver being the longest club. Thus, if the driver were 43 inches long, the number two wood would be 42½ inches long, the number three wood 42 inches, etc. Other manufacturers use the same principal except that they vary their shaft lengths by ¼ inch increments.

In addition to the manufacturers varying the length of each club in a set, they also vary the lie of each club. Longer irons and woods have flatter lies than do shorter irons and woods. Thus, a number nine iron is a shorter more vertical club that a number one iron which, in turn, causes the golfer to stand much closer to the ball when using a nine iron than when using a one iron. This difference in clubs causes the golfer to swing each club differently.

Under current golf club design, the manufacturers also lighten the weight of the club head as the clubs get longer. Thus each club will have a different club head weight, different club shaft length, different lie and different total club weight. The combination of all of these factors in turn requires the golfer to take a different stance and thus a different swing for each club. To be proficient, the golfer must train his muscles to "remember" the 14 different stances and swings for each golf club. This generally can only be accomplished by repetitiously hitting balls with each club. Thus, the explanation why an amateur will hit good and bad shots with the same club and why an amateur will play one club better than another. All amateur golfers seem to have at least one club they feel very comfortable hitting with and other clubs they avoid using because they can never seem to swing the club properly. This is because each club has individual design parameters and therefore must be swung differently. This variance in the individual club design and resultant swing also explains why there is a much greater difference between the professional and the amateur in golf than in any other sport. Muscle memory is 99% of the game and there are 14 clubs to memorize as opposed to one racket in tennis or one bat in baseball.

It is therefore an object of the present invention to provide a set of golf clubs that standardizes as many of the golf club design criteria as possible from club to club so that the number of swings a golfer must memorize is greatly reduced. With the present invention, the golfer only has to memorize two golf swings: one for the irons and one for the woods.

Golf clubs are also presently designed with the club head weight distribution based on the assumption that the club head is acting as a free flying object when it hits the ball. Thus, the designers tend to think in terms of club head center of gravity rather than total club center of gravity and the club heads are weighted accordingly. A typical iron, for example, will have approximately 57% of the club head weight on the toe half of the club head and 43% of the weight in the heel half of the club. When the club head is connected to the shaft via the heel, the addition of the hosel portion of the shaft and glue to the heel portion of the club head brings the club head weight distribution back to approximately 50% for each half of the club head. This weight distribution, however, does not account for the weight of the grip and the shaft above the hosel.

Research by the applicant has indicated that when a ball strikes the dead center of the face of a prior art golf club, the head still tries to rotate about its shaft. This is despite the 50/50 club head weight distribution of current club designs. In reality, the shaft weight cannot be ignored if club head rotation is to be reduced.

It is therefore an object of the present invention to provide a golf club with an improved center of gravity through proper club weight distribution thereby reducing the rotation of the club when it strikes the ball.

While rotation of the golf club is dependent upon the center of gravity of the club, it is also dependent upon the grip design as well. Presently, golf club grips are substantially circular with some tapering or change in diameter. Some grips have the added feature of ribbing on the bottom of the grip. Such designs tend to rotate easily in the hands and provide little assistance in preventing rotation of the club head.

It is therefore an additional object of the present invention to provide a golf club with an improved grip design to further minimize club head rotation.

Other objects and advantages of the present invention will become apparent from a further review of the following specification, claims and drawings.

SUMMARY OF THE INVENTION

The present invention relates to an improved set of golf clubs wherein all the irons have the same club length, lie and weight. Similarly, the club lengths, lies and weights for all the woods are the same. In addition, the center of gravity of the entire club on both the irons and the woods is located at the center of the striking face of the club head. Thus, the only variant with both the woods and irons is the loft of the particular club. As a result, the golfer only has to learn or memorize one swing for all the irons and another swing for all the woods, thereby alleviating the need to memorize a separate swing for each of the irons and woods. This greatly simplifies the learning process for the golfer and is designed to improve his or her game.

An improved golf grip has also been designed which has enhanced gripping and aligning characteristics which can be used with applicant's golf clubs or with conventional golf clubs to help counteract the club head twisting problems resulting from the improper location of the center of gravity on existing clubs. The grip is composed of a hard inner core and a soft compressible outer cover which deforms to fit the contour of the golfer's hands. The configuration of the grip is such that the top and bottom are rounded and the sides of the grip are flat and parallel to one another and the striking face of the club. With this design, club head rotation can be greatly reduced.

DESCRIPTION OF THE PREFERRED EMBODIMENT

Figure 2:
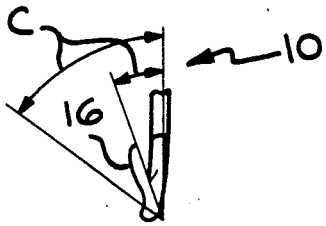
FIG. 2 is a front elevational view of a golf club head showing the varying angles of loft of an iron.

Referring now to FIGS. 1-4, there is shown two golf clubs, 10 and 12 according to the present invention. Golf club 10 is an iron and representative of all of the irons of applicant's invention. Golf club 12 is a wood and is representative of all the woods of applicant's invention.

Iron 10 has a shaft 14, a club head 16 with striking face 18, toe 20, heel 22, hosel 24 and grip 26. All of applicant's irons have the same club length, club lie and club weight distribution/center of gravity. The only varying factor with each of the irons is the loft of the club. The wood 12 has a shaft 15, club head 17 with striking face 19, toe 21, heel 23, hosel 25 and grip 27. As with the irons, all of applicant's woods have the same club length, club lie and club weight distribution/center of gravity. The only varying factor with each of the woods is the loft of the clubs. Generally, the common length and weight of the woods 12 will be longer and lighter than the common length and weight of the irons 10 and the common lie of the woods 12 will be flatter than the common lie of the irons 10. The actual club lengths, lies, weights, shaft stiffnesses, etc., will depend upon the physical size of each individual golfer if the clubs are to be custom made. Otherwise, several common club lengths, lies, weights and shaft stiffnesses can be used to accomodate the general golfing public, as for example, by making stock sets of clubs in short, standard and long sizes to fit similarly sized golfers.

With prior art golf club sets, the club loft, length, lie and club head weight is varied for each of the clubs. This is why the golfer must learn how to swing each individual club. To this end, club weight and weight distribution are particularly crucial to proper club desigh. With present golf clubs, the manufacturers progressively lighten the club heads as the clubs get longer. Thus, the club head on the number two iron will weigh less than the club head on the number nine iron as the two iron is longer than the nine iron.

After studying the club lenghts, weights and club head speeds of various golf clubs, Applicant has determined that the kinetic energy of a given player's club head is virturally the same from the number of one to the number nine iron and from the number one to the number seven wood. This means that while a number two iron can be swung faster than, for example, a number three through nine iron, the fact that the club head is lighter means the ball will not go any furtgher except for the fact of the lower loft of the club. Thus, if all irons were the same length, the same grip and same club weight and lie, the golfer would suffer no penalty relative to the club's ability to achieve distance. In addition, because all the clubs have the same club length, lie and weight, the golfer would only have to memorize two stances and swings—one for the irons and one for the woods. This would permit the golfer to significantly increase the percentage of properly hit shots.

Figure 1:
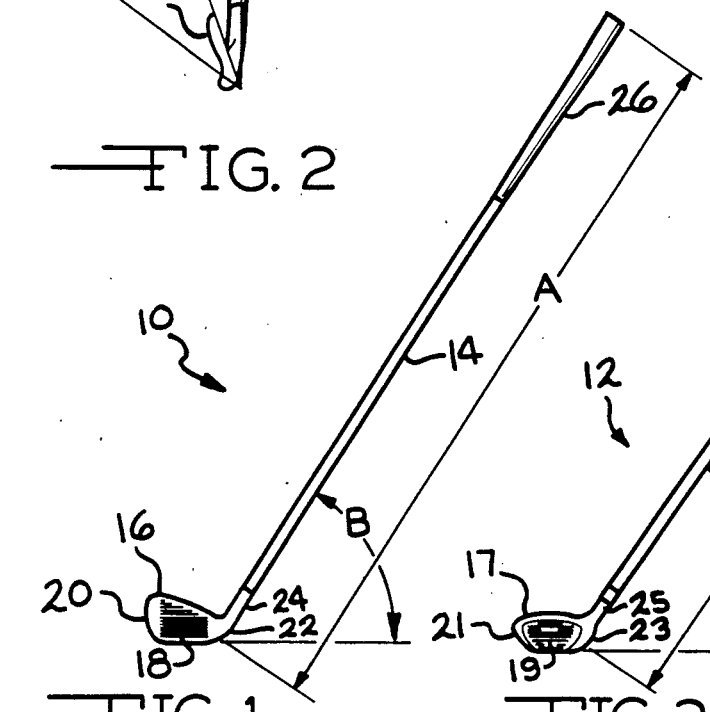
FIG. 1 is a side elevational view of a golf club representative of all the irons according to the present invention.
Figure 3:
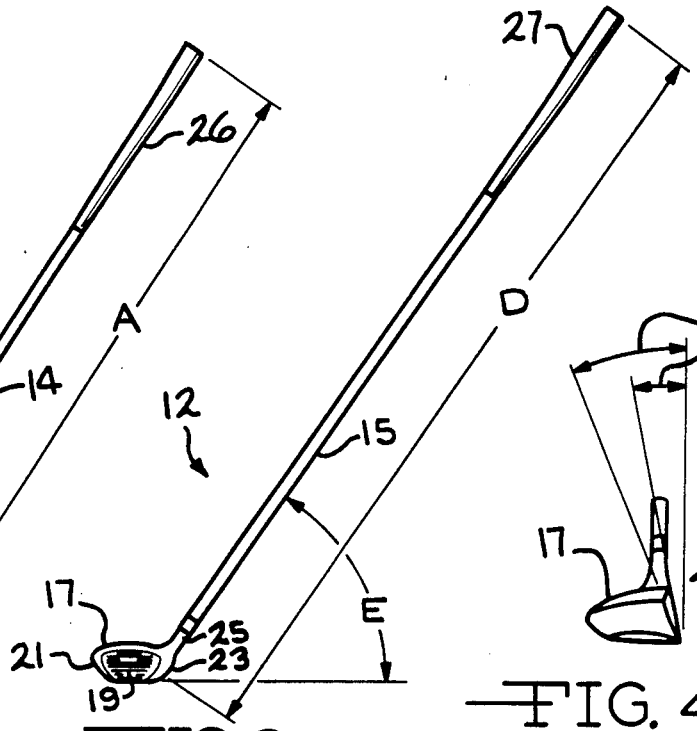
FIG. 3 is a side elevational view of a golf club representative of all the woods according to the present invention.
Figure 4:
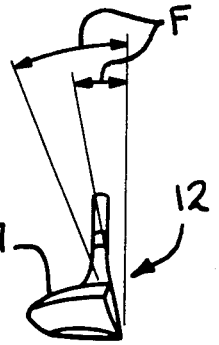
FIG. 4 is a front elevational view of a golf club head showing the varying angles of loft of a wood.
Figure 13:
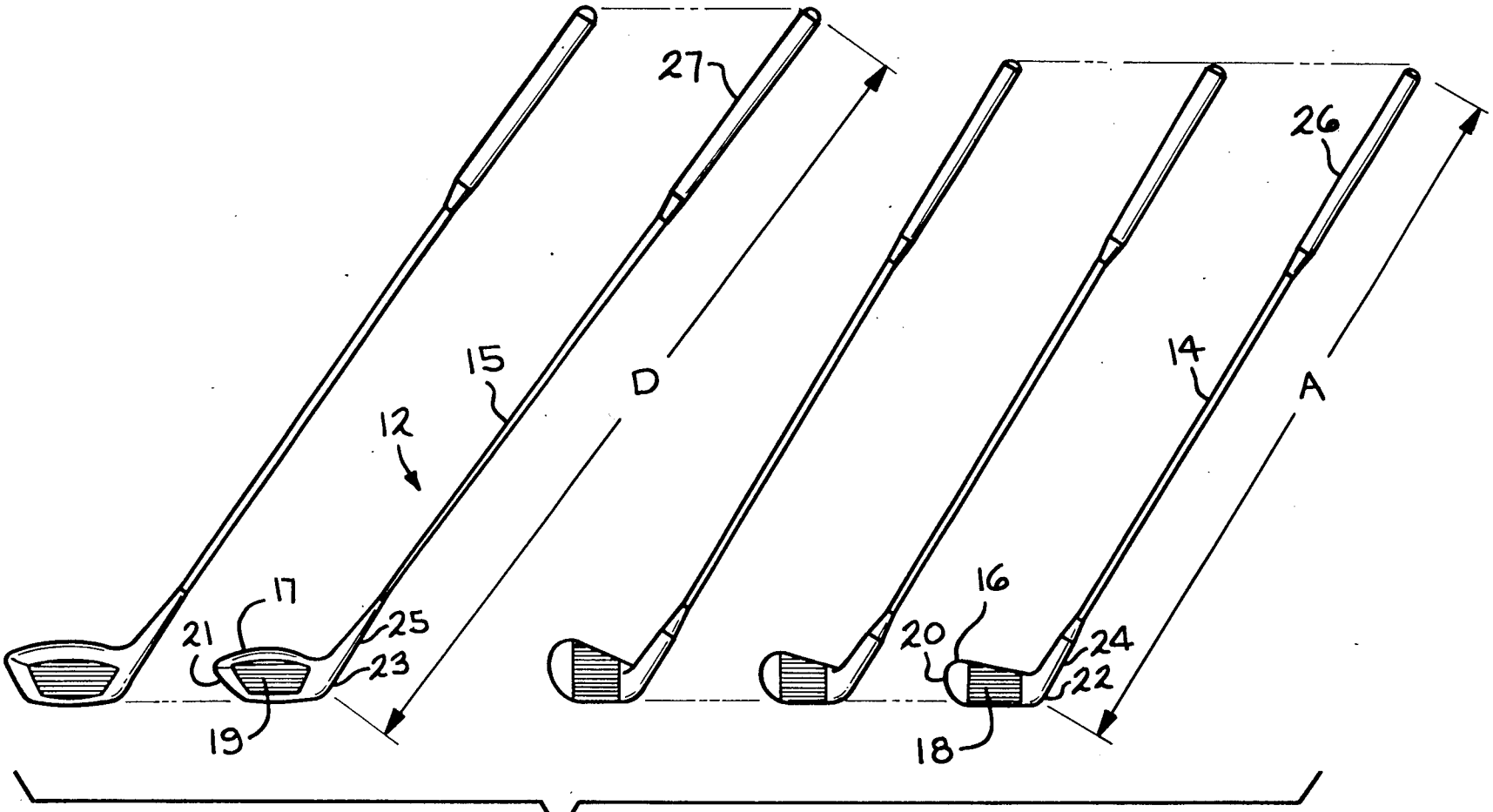
FIG. 13 is a side elevational view of the golf clubs showing the common length for the iron type clubs and the common length for the wood type clubs.

Accordingly, all the irons 10 in FIG. 1 and FIG. 13 are the same length A and have the same lie B. All of the shafts 14 for the irons are also the same length. Only the loft C of each iron 10 will vary from club to club. Typically, the loft C for the irons 10 will range from 17° for a number one iron to 58° for a sand wedge. Similarly, all of the woods 12 are the same length D and have the same lie E. All of the shafts 15 for the woods are also the same length. As with the irons, the loft F of each wood 12 will vary from club to club. Typically the loft F for the one through seven woods will range from 10° to 29°.

Figure 5:
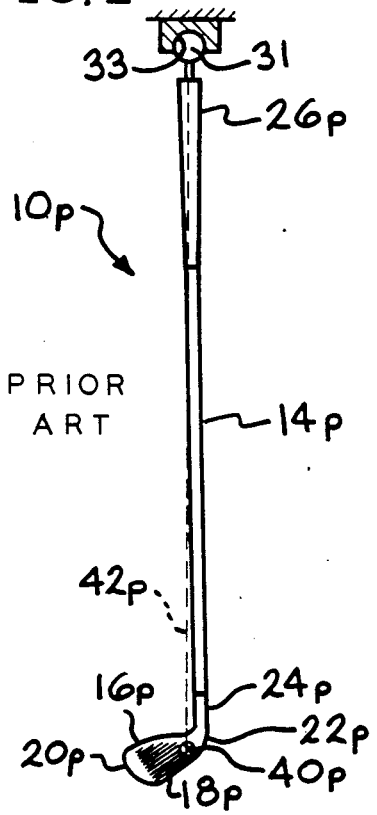
FIG. 5 is a side elevational view of a prior art golf club with a plum line attached to the grip to locate the club center of gravity.
Figure 7:
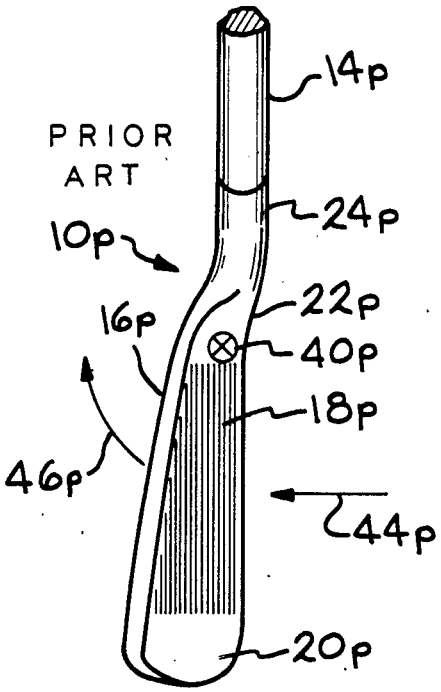
FIG. 7 is a view of a prior art iron showing the center of gravity located in the heel of the club.
Figure 8:
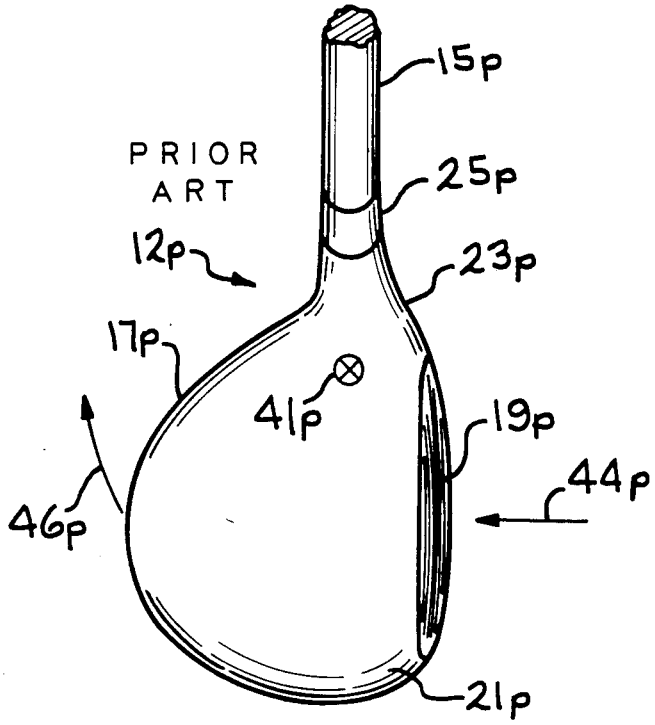
FIG. 8 is a top view of a prior art wood showing the center of gravity located in the heel of the club.

In addition to all of Applicant's irons 10 and 12 having uniform lengths and lies, they also have a uniform distribution of the total club weight relative to their respective centers of their faces 18 and 19. FIGS. 5, 7 and 8 illustrate the present design of golf clubs and the effect the design has on the club's ability to strike the ball properly. (FIGS. 5, 7 and 8 use the same number designation as Applicant's clubs except for the use of a lower case p in conjunction with the numbers to indicate that it is a prior art design of club). Present golf club design places 50% of the club head weight in the toe and 50% of the club head weight in the heel of the club head and ignores the effect and weight of the shaft. Referring to FIG. 5, the center of gravity 40*p* of a club 10*p* can be located by using a plumb line 42*p* and suspending the club 10*p* by the end of its grip 26*p*. The club 10*p* is suspended at the centerpoint on the top of the grip 26*p*. Usually, there is a small hole at the centerpoint on the top of the grip. The centerpoint of the grip 26*p* is suspended from a ball 31 that is supported in a socket or cup 33. This allows the ball to freely rotate and allows the club 26*p* to more or less rotate based on the weight distribution for the club. The plumb line 42*p* is in the same plane as the centerpoint of the grip and provides a guide for finding the center of percussion or center of gravity 40*p* for the club 10*p*. This same system is used to find the center of percussion or center of gravity 40*p* for the club 14 shown in FIG. 6. Where the plumb line 42*p* and club head 16*p* intersect is a good approximation of the center of gravity 40*p* of the club 10*p*. Using the 50/50 heel to toe weight distribution of present clubs, the club 10*p* in FIG. 5 has its center of gravity 40*p* located in the heel portion 22*p* of the club 10*p*, very close to the hosel 24*p*. However, the club head is designed to have the golf ball hit the dead center of the club face 18*p*. Thus, when the ball is hit with a prior art design of golf club 10*p*, the point of club face contact 44*p* and the center of gravity 40*p* for the golf club do not coincide as shown in FIGS. 7 and 8. As a result, a moment arm is created which can cause the club face 18*p* to rotate about the hosel 24*p* and shaft 14*p* in the direction of arrow 46*p*, thereby creating the club twisting problem referred to above.

Figure 9:
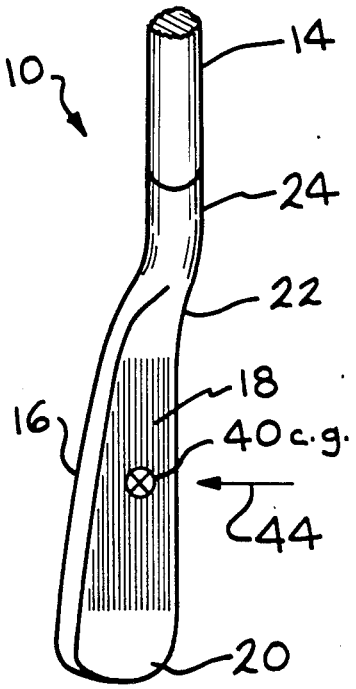
FIG. 9 is a top view of an iron representative of Applicant's irons showing the center of gravity located at the center of the club face.
Figure 10:
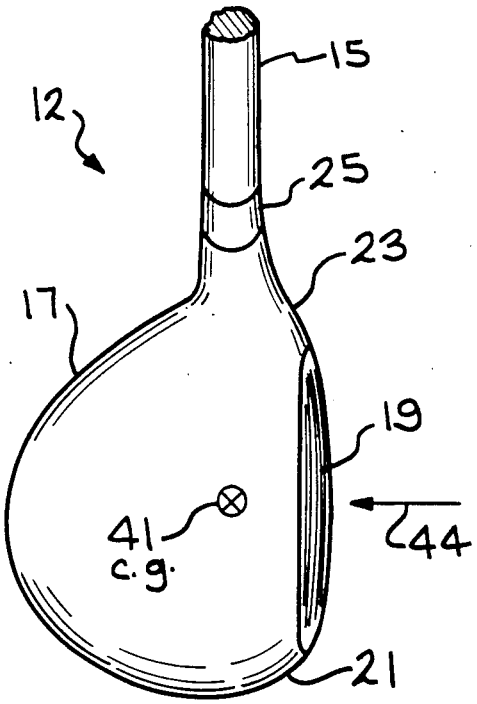
FIG. 10 is a top view of a wood representative of Applicant's woods showing the center of gravity located at the center of the club face.

With Applicant's clubs, the club weight is distributed so that the center of gravity 40 and 41 of irons 10 and woods 12 coincide with the point 44 at which the ball contacts the respective club faces 18 and 19 as shown in FIGS. 9 and 10. As a result, any twisting caused by the creation of a moment arm is greatly reduced. This is achieved by placing one-half of the total club weight in the toe half 20 of the irons 10 and similarly for the woods, one-half of the total club weight in the toe 21.

As an example of the difference between the club weight distribution in Applicant's clubs and prior art clubs, an iron with a 50 gram grip, 100 gram shaft and 280 gram head would have a total club weight of 430 grams. With prior art club design, the club head weight in the toe half of the club would be close to 160 grams. In contrast, Applicant's design would place one-half of the total club weight or 215 grams in the toe of the club. This represents a radical departure from present designs in that there is a 34.4% increase in the toe weight of Applicant's club.

Figure 6:
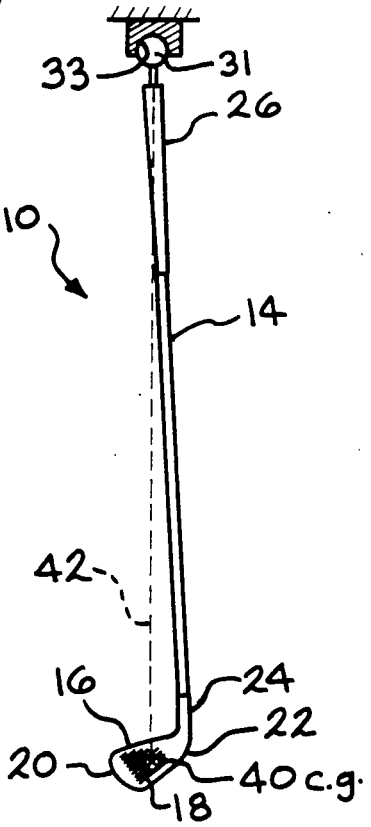
FIG. 6 is a side elvational view of a golf club representative of all of Applicant's clubs with a plum line attached to the grip to locate the club center of gravity.

By increasing the toe weight 20 of the iron 10, the weight of the whole iron 10 is taken into account in properly locating the center of gravity 40 of the iron 10 at the center of the club striking face 18 (See FIG. 6). If a plum line 42 is attached to the grip 26 of Applicant's club 10 as shown in FIG. 6, the plum line 42 intersects the club head 16 at the center of the striking face 18. This is because the increased toe weight counterbalances the actual effects the weight of the shaft 14 and grip 26 have on the swing characteristics of the club 10. As a result, the club center of gravity 40 is moved from the heel 20 to the center of the striking face 18, thereby reducing the tendency of the club 10 to twist in the player's hands when the ball is struck at the proper location in the center of the club face. This same shift of the total club weight is also applied to the woods 12 thereby reducing the club twisting problem with the woods too. One-half of the total club weight is placed in the toe portion 21 of wood 17 shown in FIG. 10. As a result, the club center of gravity 41 is again moved from the heel 23 of the club (FIG. 8) to a location in line with the center of the striking face 19, thereby causing the point of ball contact 44 and the center of gravity 41 to coincide (FIG. 10).

Figure 11:
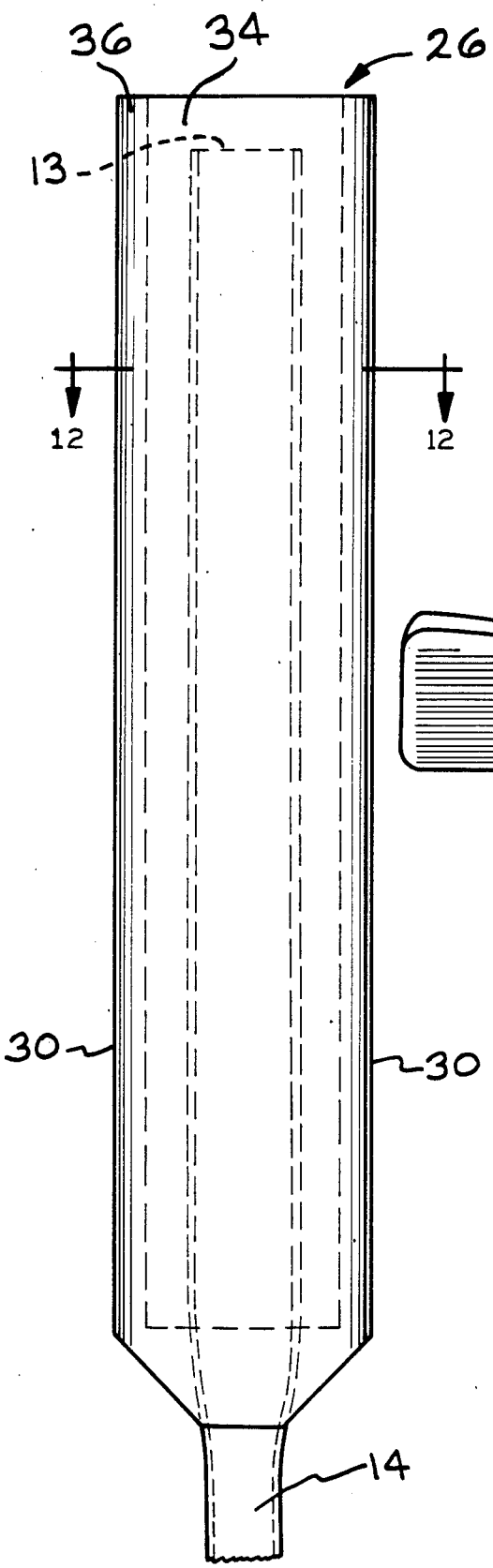
FIG. 11 is a side elevational view of Applicant's golf club grip with the inner core and shaft shown in phantom.
Figure 12:
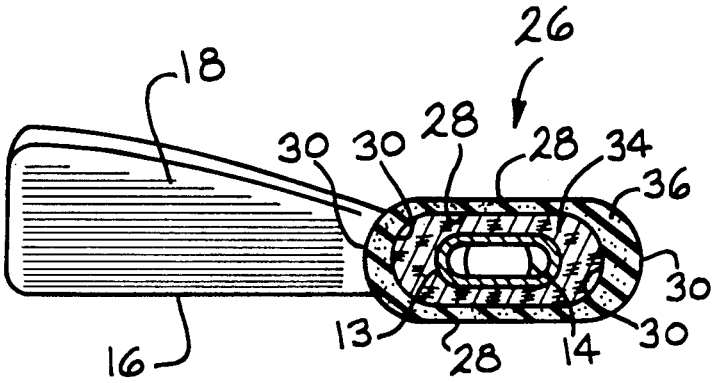
FIG. 12 is a sectioned end view of the golf club grip in FIG. 11 taken along line 12—12.

To further reduce the twisting problem with present clubs and to better ensure proper club face alignment, Applicant has also improved the grips 26 and 27 of irons 10 and woods 12 as can be seen in FIGS. 11 and 12. Grips over the years have been substantially round with some tapering or change in diameter. Deviations from this design have been slight with the addition of ribbing on the underside of the golf grip. Referring to FIGS. 11 and 12, there is shown a grip 26 which is representative of both the grips 26 and 27 on irons 10 and woods 12 respectively. The Applicant's grip 26 is substantially rectangular in shape with flat parallel sides 28 and rounded ends 30. To assist in achieving this shape, the end 13 of the shaft 14 about which the grip 26 is positioned can be, but does not necessarily need to be, flattened on the sides to more closely resemble the exterior contour of the grip 26. The grip 26 is contructed of an inner core 34 and an outer covering 36. Both the inner core 34 and the outer covering 36 have flat parallel sides 28 and rounded end 30. The parallel sides 28 of the grip 26 are positioned such that they are substantially parallel to the leading edge of the club head 16 and the score lines on the club face 18. Thus, when the golfer grips the club, his or her palms contact the flat side 28 of the grip 26, thereby placing the golfer's hands parallel to the score lines on the club face 18 of iron 10 and ensuring proper alignment of the club. The same is also true with the woods 12.

Under current USGA rules, grips cannot be premolded to the hands. The Applicant's grip 26 is therefore designed to mold to the shape of the hands after it is gripped. To accomplish this, the inner core 34 is constructed of non-compressible material such as high-durometer rubber or cork. The inner core 34 is used to increase the diameter of the grip 26 to approximately fit the golfer's hands. The compressible outer cover 36 is then attached to the inner core 34. The outer cover 36 is constructed of a light weight material which is wear-resistant and compressible, such as sponge rubber. As a result, when the golfer's hands are wrapped around the grip 26, the outer cover 36 deforms to the contour of the golfer's hands, thus improving the golfer's grip. In addition, because the grip 26 is substantially rectangular in shape, the grip 26 is less likely to twist should the club face strike the ball off center. This grip design enhances the playability of Applicant's clubs and is also particularly helpful when used with prior art golf clubs to help control the club head twisting problem outlined above.

In conclusion, applicant's new and improved golf clubs with common club lengths and lies and improved weight and grip characteristics result in a set of clubs which are easier to use. The golfer only has to memorize one swing for the irons and one swing for the woods due to their uniform design. This is a significant improvement over prior art golf club set designs.

Having thus described the applicant's invention in detail, it should be understood that various modifications and changes can be made in the invention without departing from the scope and spirit of the following claims.

What I claim is:

1. A set of golf clubs including a plurality of common length and weight iron type clubs and a plurality of common length and weight wood type clubs comprising:

a plurality of first shafts for said iron type clubs and a plurality of second shafts for said wood type clubs, said plurality of first and second shafts having a first end and a second end, said plurality of first shafts having a common length and weight for each of said iron type clubs and said plurality of second shafts having a common length and weight for each of said wood type clubs;

a grip positioned on said first end of said first and second shafts;

an iron type club head positioned on said second end of said plurality of first shafts, said iron type club head having a common weight and lie, said iron type club head having a heel portion including a hosel connected to said second end of said first shaft, a toe portion spaced apart from said shaft and a striking face, a wood type club head positioned on said second end of said plurality of second shafts, said wood type club head having a common weight and lie, said wood type club head having a heel portion including a hosel connected to said second end of said second shaft, a toe portion spaced apart from said shaft and a striking face, said weight for said entire iron type and wood type clubs being distributed so that one-half of said weight lies in said toe portion of said club heads and the remaining one-half a said club weight lies in said grip, shaft, heel portion of said clubs and the center of gravity of said iron type and wood type clubs is positioned at substantially the center of said iron type and wood type club head.

2. The golf clubs of claim 1 wherein said center of gravity for said iron type and wood type clubs is positioned substantially behind the center of said striking face for said iron type and wood type clubs.

3. The golf clubs of claim 1, wherein said second shafts for said wood type clubs are longer than said first shafts for said iron type clubs.

4. The golf clubs of claim 1, wherein said weight of said wood type clubs is lighter than said weight of said iron type clubs.

5. The golf clubs in claim 1, wherein said grip has a substantially rectangular cross-section with opposed substantially flat and parallel sides and rounded ends extending between said opposed sides.

6. The golf clubs of claim 6 wherein said opposed sides of said grip are disposed substantially parallel to said leading edge of said club head and said score lines on said striking face of said golf club.

7. The golf clubs of claim 6, wherein said grip has a substantially non-compressible core positioned adjacent said shaft and a wear-resistant compressible outer cover positioned over said substantially non-compressible core.

8. The golf clubs of claim 7, wherein said first end of said first and second shafts has a substantially rectangular cross-section for receiving said grip having a substantially rectangular cross-section.

9. A set of golf clubs including a plurality of iron type clubs and a plurality of wood type clubs comprising, a plurality of first shafts for said iron type clubs and a plurality of second shafts for said wood type clubs, said plurality of first and second shafts having a first end and a second end, said plurality of first shafts having a common length and weight for each of said iron type clubs and said plurality of second shafts having a common length and weight for each of said wood type clubs, said plurality of second shafts for said wood type clubs being longer than said plurality of first shafts for said iron type clubs;

a grip positioned on said first end of said plurality of first and second shafts;

an iron type club head positioned on said second end of said plurality of first shafts, said iron type club having a common weight and lie, said iron type club head having a heel portion including a hosel connected to said shaft, a toe portion spaced apart from said shaft and a striking face, a wood type club head positioned on said second end of said plurality of second shafts, said wood type club head having a common weight and lie, said wood type club head having a heel portion including a hosel connected to said shaft, a toe spaced apart from said hosel and a striking face, said weight of said wood type club being lighter than said weight of said iron type club, said weight for said entire iron type and wood type clubs being distributed so that one-half of said club weight lies in said toe portion of said club head and the remaining one-half of said club weight lies in said grip, shaft, and heel portion of said club and the center of gravity of said iron type and wood type clubs is positioned at substantially the center of said iron type and wood type club heads behind the center of said striking face for said iron type and wood type clubs;

said grip having a substantially rectangular cross-section with opposed substantially flat and parallel sides and rounded ends extending between said opposed sides, said opposed sides of said grip being disposed substantially parallel to said leading edge of said club head and said score lines on said striking face of said golf club, said grip having a substantially non-compressible core positioned adjacent said shaft and a wear-resistant compressible outer cover positioned over said substantially non-compressible core and said first end of said first and second shaft having a substantially rectangular cross-section for receiving said grip having a substantially rectangular cross-section.

10. An improved set of golf clubs including a plurality of irons and a plurality of woods, each of said clubs including a shaft having a first and second end, a grip positioned about said first end of said shaft, a club head attached to said second end of said shaft by a hosel, said club head having a toe, a heel, and a striking face, said grip having a substantially rectangular cross-section with opposed flat parallel sides and a rounded top and bottom, said sides being substantially parallel to the leading edge of the club head and the score lines on the striking face of said club head, said grip being constructed of a substantially non-compressible core covered by a wear-resistant compressible outer cover, said irons having a first common club length, first common club weight and first common club lie, said woods having a second common club length, a second common club weight and a second common club lie, said second common club length of said woods being longer than said first common club length of said irons, said second common club weight of said woods being lighter than said first common club weight of said irons, said second common club lie of said woods being flatter than said first common club lie of said irons, one-half of said first and second common club weights lying in said toe of said club heads and the remaining one-half of said club weights lying in said grip, shaft, hosel and heel of said clubs, whereby the center of gravity of said clubs lie at the approximate center of said club faces.

* * * * *